United States Patent [19]

Giolitti

[11] 4,336,762

[45] Jun. 29, 1982

[54] ELECTROMECHANICAL ACTUATOR DEVICE FOR A SEWING MACHINE

[75] Inventor: Nicolo' Giolitti, Ivrea, Italy

[73] Assignee: Arnaldo Vigorelli S.p.A., Pavia, Italy

[21] Appl. No.: 140,980

[22] Filed: Apr. 17, 1980

[30] Foreign Application Priority Data

Apr. 23, 1979 [IT] Italy ..... 67846 A/79

[51] Int. Cl.[3] ..... D05B 3/02

[52] U.S. Cl. ..... 112/158 E

[58] Field of Search ..... 112/158 E, 158 D, 158 R, 112/158 A, 158 B, 121.11, 220

[56] References Cited

U.S. PATENT DOCUMENTS

| | | | |
|---|---|---|---|
| 3,929,081 | 12/1975 | Ketterer | 112/158 E |
| 4,068,604 | 1/1978 | Skogward | 112/158 E |
| 4,074,641 | 2/1978 | Tholander et al. | 112/158 E X |

*Primary Examiner*—Peter P. Nerbun

*Attorney, Agent, or Firm*—Merriam, Marshall & Bicknell

[57] ABSTRACT

An electromechanical actuator device for a sewing machine is described.

The main feature of said device is that it comprises a plurality of electromagnets, each of which is arranged to be put into either a rest state or a working state, depending upon a respective electrical feed signal; at least one actuator member connectable to a fabric conveying foot in the said sewing machine and arranged to assume either a rest position or a working position corresponding respectively to said rest state or working state of each of said electromagnets; a plurality of mechanical coupling means disposed between said plurality of electromagnets and said actuator member, and a drive shaft which is actuated by means of a power take-off and actuates the said mechanical coupling means; each of said mechanical coupling means being arranged to be put either into a respective rest position or working position, depending on the state of a corresponding electromagnet, and to mechanically set said actuator into either said rest position or working position.

20 Claims, 15 Drawing Figures

Fig. 2
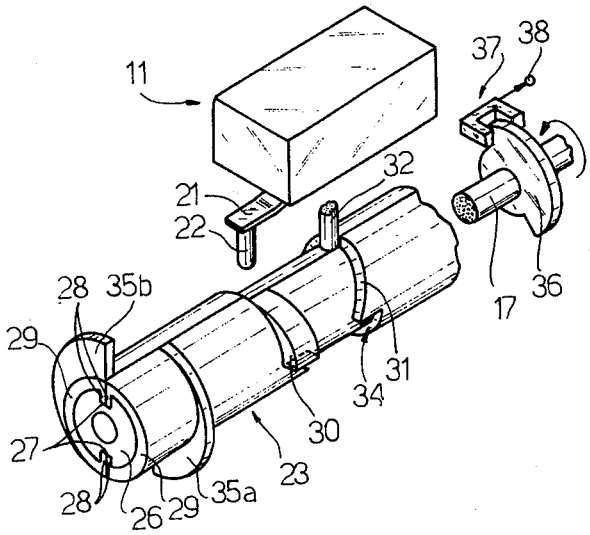
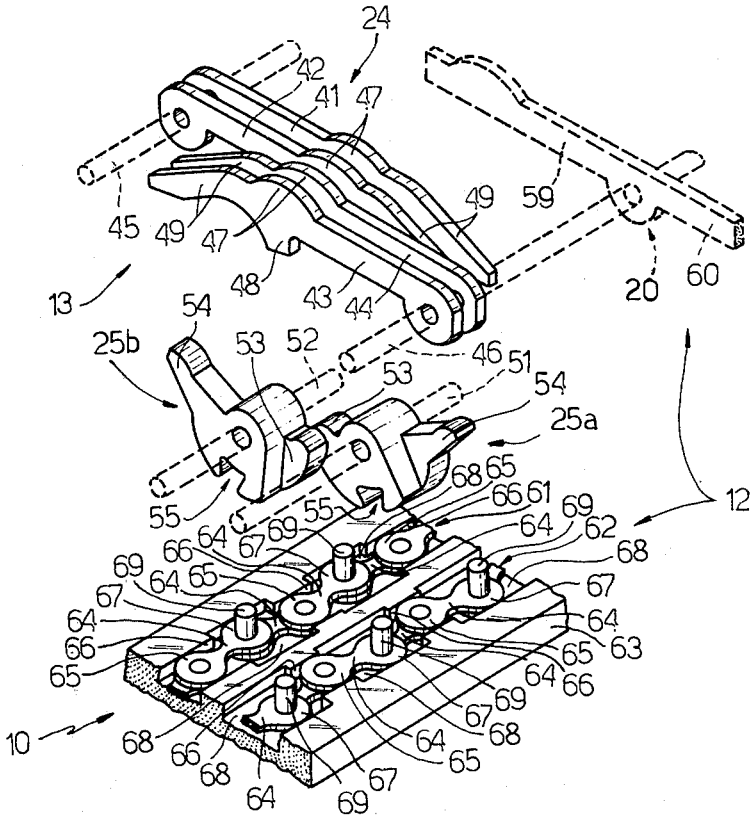

19
64
65
62
64
68
92
88
61
91
68
67
64
66
65
64
68
67
64
66
65
64
68
69
67
66
64
65
64
68
69
67
64
66
65
64
68
67
66
64
65
64
68
69
67
64
66
65
64
68
69
67
64
65
92
69
91
92
69
91
92
69
91
92
91
92
69
91
92
69
91
92
69

ELECTROMECHANICAL ACTUATOR DEVICE FOR A SEWING MACHINE

BACKGROUND OF THE INVENTION

This invention relates to an electromechanical actuator device for a sewing machine.

In particular, this invention relates to a device of the type comprising an input arranged to receive an electrical signal, and an output comprising a mechanical member, the movements of which depend on the said input signal and define the position of a needle bar and conveying foot in a sewing machine.

These actuator devices are classified as either analogue or logic, according to the type of electrical input signal.

Analogue actuators include the linear motor, in which the axial position of a respective slider is controlled by a closed loop electronic circuit. This circuit provides the motor with an electrical feed signal until the said slider reaches a predetermined position, as detected by means of a suitable sensor. The cost of such motors is generally relatively high, and this is increased by the cost of the relative closed loop control circuit.

Logic actuators include devices comprising a plurality of electromagnets which act on a mechanical decoder unit. Each electromagnet is fed with a logic signal having a predetermined "weight", and operates a corresponding element of the said mechanical unit, which produces a movement of a predetermined extent, proportional to the "weight" of said logic signal. As each electromagnet acts directly on a respective element of the mechanical unit, it is generally necessary to use electromagnets of high power, which consequently have a high current absorption, have operating times which are difficult to control, particularly in the case of high operating speeds, and are particularly nose.

Such electromechanical actuator devices are often used in sewing machines provided with electronic control units comprising microcomputers. These microcomputers produce logic output signals, and thus analogue actuator devices require the use of further digital-analogue converter circuits in such cases, with consequent further expense which is added to the already considerably high cost.

SUMMARY OF THE INVENTION

The object of the present invention is to provide an electromechanical actuator device for a sewing machine, in which the aforesaid drawbacks of known devices are absent.

The present invention provides an electromechanical actuator device for a sewing machine, characterized by comprising a plurality of electromagnets, each of which is arranged to be put into either a rest state or a working state, depending upon a respective electrical feed signal; at least one actuator member arranged to assume either a rest position or a working position corresponding respectively to said rest state or working state of each of said electromagnets; and a plurality of mechanical coupling means disposed between said plurality of electromagnets and said actuator member, and operated by means of a power take-off; each of said mechanical means being arranged to be put either into a respective rest position or working position, depending on the state of a corresponding electromagnet, and to mechanically set said actuator member into either said rest position or working position.

BRIEF DESCRIPTION OF THE DRAWINGS

The present invention will be more apparent from the description given hereinafter by way of non-limiting example, of a preferred embodiment with reference to the accompanying drawings in which:

FIG. 2 is a perspective exploded view of a preferred mechanical embodiment of the device of FIG. 1;

DETAILED DESCRIPTION OF THE INVENTION

Figure 1:
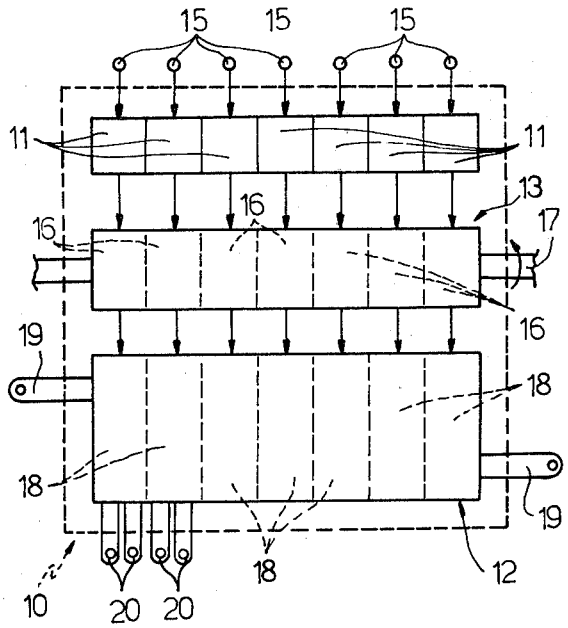
FIG. 1 is an operational diagram of an electromechanical actuator device constructed in accordance with the present invention.

With reference to FIG. 1, an electromechanical actuator device is indicated overall by the reference numeral 10, and comprises substantially a plurality of electromagnets 11, an actuator member 12, and mechanical coupling means 13 disposed between the electromagnets 11 and the actuator member 12. Each electromagnet 11 comprises a feed input connected to a respective terminal 15, and acts on a corresponding element 16 of the coupling means 13, the element being driven by a shaft 17.

Each element 16 of the coupling means 13 is arranged to act mechanically on corresponding elements 18 of the actuator member 12, which comprises two different actuator units. The output member of a first unit is in the form of rods 19, which can move axially through a predetermined distance, which is determined by the difference between the working and rest positions of a combination of actuator elements 18. The output member of the second unit is in the form of levers 20, each of which is arranged to assume a first or second position in the axial or angular direction.

FIG. 2 shows a portion of the actuator device 10, comprising one of the electromagnets 11, the actuator member 12 and a portion of the mechanical coupling means 13.

Figure 3:
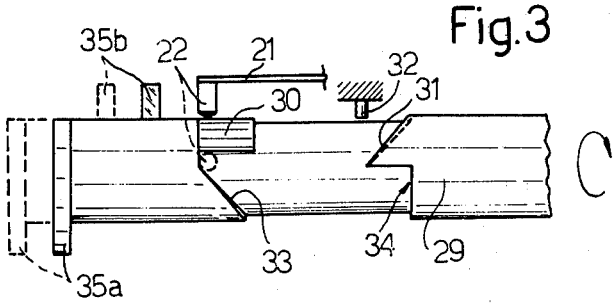
FIG. 3 is a side view of a first portion of the mechanism of FIG. 2.

The electromagnet 11, which will be described in greater detail with reference to FIG. 3, is of the type which has to be reset mechanically, and comprises a mobile armature 21, on one end of which there is disposed a tooth 22.

The coupling means 13 comprise a clutch 23, a plurality of control levers 24 and a pair of rocker arms 25*a* and 25*b*, in that order.

The clutch 23 is driven by the drive shaft 17 (shown in FIG. 1), and comprises a tubular sleeve 26 comprising on its outer surface two diametrically opposite axial slots 27 in which there engage the radial projections 28 branching from opposite facing peripheral surfaces of semi-tubular elements 29, so that each of these latter can slide axially with respect to the sleeve 26.

With reference to FIGS. 2 and 3, said two elements 29 both extend over a circular arc of 180°, and are substantially equal. Each of them comprises a projection 30 over a first angle of less than 90°, the projection extending radially outwards and arranged to cooperate with the tooth 22 of the armature 21 of the electromagnet 11, in order to mechanically reset said electromagnet. Over said first arc of 90°, the element 29 comprises an oblique recess 31, a surface of which is arranged to cooperate frontally with a peg 32 which is fixed relative to the element 29 so as to determine, within the first 90° of rotation of the shaft 17, an axial displacement of the element 29 between its working position and rest position.

Each element 29 (see FIG. 3) comprises, on the same side as the projection 30, an oblique recess 33 extending over a second angular portion of between 90° and 180°, and positioned in the opposite direction to the recess 31, it being arranged to cooperate with the tooth 22 carried by the armature 21 so as to cause the element 29 to displace axially from said rest position to said working position. On the opposite side, the radial recess 31 correspondingly comprises a rectangular cavity 34 to prevent any interference of the element 29 with the peg 32 during any axial movement of the element 29 towards said working position.

Each of the semi-tubular elements 29 carries a cam 35*a* and 35*b* respectively, which are axially offset from each other, and extend radially and progressively from the outer surface of each element 29. In FIG. 3, the cams 35*a* and 35*b* are shown in their rest position in full line, and in their working position in dashed line.

With particular reference to FIG. 2, the shaft 17 rotates a semicircular disc 36 which cooperates with a device 37, for example a photoelectric element, which feeds a position and synchronism signal to a respective connecting terminal 38.

The lever group 24 comprises four levers indicated respectively by 41, 42, 43 and 44, the first two of which have one end pivoted to a support pin 45, and the second two have one end mounted rotatably about a support pin 46. Each of said levers comprises, in an intermediate position, a rounded portion 47 which cooperates frontally with the outer surface of the cam 35*a* in the case of the levers 41 and 42, and with the outer surface of the cam 35*b* in the case of the levers 43 and 44. Each lever of said group 24 comprises a tooth 48 in a position corresponding with the rounded portion 47 but on the opposite side, and finally each of said levers extends longitudinally beyond the portion 47 in the form of an end appendix 49.

The rocker arms 25*a* and 25*b* are equal to each other and are mounted rotatable about respective support pins 51 and 52, and each of them comprises at opposite ends two teeth, 53 and 54 respectively, which are offset axially from each other. The tooth 53 is at a smaller radial distance from the respective pin than the tooth 54, and after assembly it can cooperate with the tooth 48 of each of the levers of the group 24, while the tooth 54 cooperates with the end appendix 49 of each of said levers.

Each rocker arm 25*a*, 25*b* comprises an axial slot 55 in a central position but on the side opposite that which faces the lever group 24, this slot extending parallel to the respective pin 51, 52, and over the entire thickness of each of said rocker arms.

FIG. 2 also partly illustrates two different portions of the actuator member 12. In particular, one of the levers 20 of FIG. 1 is shown, this being rotatable about the pin 46 and comprising a first arm 59, the end of which is arranged to cooperate frontally with a cam, not shown in FIG. 2 but of the same type as the cams 35*a* and 35*b*, in such a manner as to receive an angular displacement control signal from said cam and to transmit this displacement to a second arm 60. This latter also comprises a pair of decoder chains indicated respectively by 61 and 62, and better illustrated with reference to FIG. 6, these being mobile within a shaped support housing 63 preferably of plastics construction. Each chain 61, 62 comprises a plurality of equal links 64, each of which comprises a first ring 65 slidable longitudinally within a respective seat 66 in the housing 63, and a second ring 67 mobile axially and longitudinally within a chamber 68 of substantially rectangular cross-section, which is also provided in the shaped housing 63.

From each second ring 67, a pin 69 extends perpendicularly to cooperate with a corresponding slot 55 either of the rocker arm 25*a* or of the rocker arm 25*b*, depending upon whether the pin 69 belongs to the chain 62 or 61. The structure of the chains 61 and 62 and of the relative slide seats 66 and chambers 68 will be described in greater detail with reference to FIG. 6.

Figure 4:
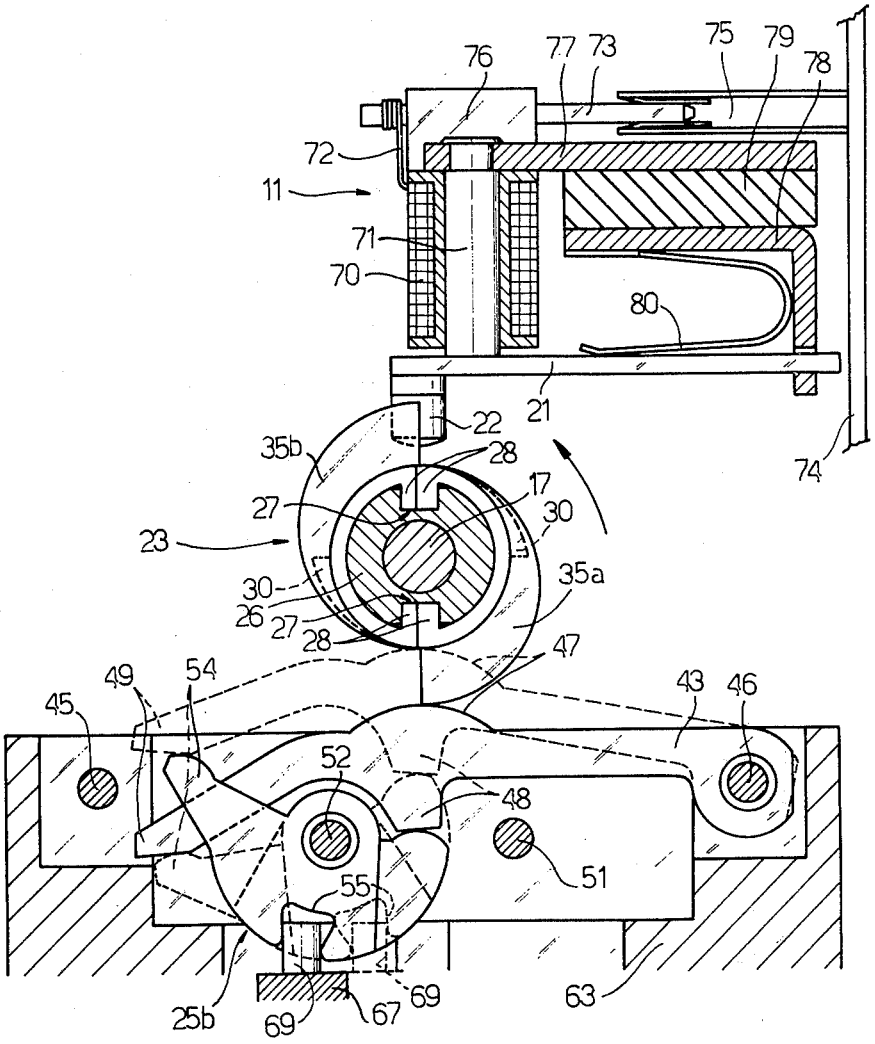
FIG. 4 is a cross-section through the mechanism of FIG. 2.

FIG. 4 shows a cross-section through the various component elements of FIG. 2 after they have been assembled. In this figure the internal structure of the electromagnet 11 is particularly visible, comprising a coil 70 wound about a magnetic core 71 and comprising supply cables 72. These latter are connected by way of strips 73 to a connector element 75 mounted on a printed circuit 74.

At that end facing the strips 73, the core 71 is connected to a support member 76 for said strips and to a plate 77 of ferromagnetic material. A L bracket of ferromagnetic material 78 is connected to this plate by a resilient element 79 of magnetic characteristics, such as magnetic rubber. One end of the armature 21 is pivoted to the free end of the L bracket 78, the armature being subjected to a resilient force tending to move it outwards. This force is exerted by a U spring 80 having one end fixed to an arm of the bracket 78, and the other end cooperating resiliently with the armature 21.

Figure 5:
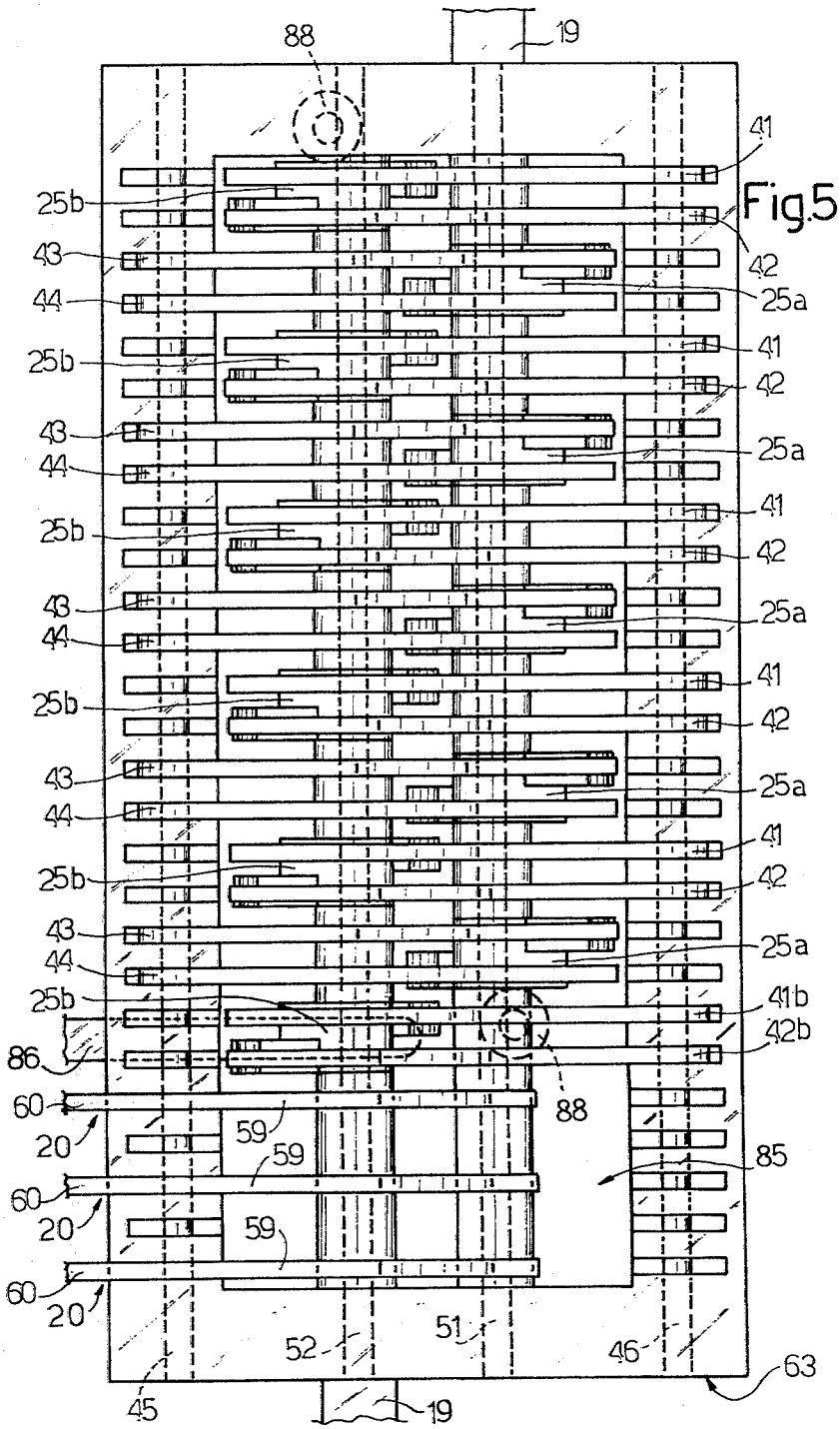
FIG. 5 is a plan view of a second mounted portion of the mechanism of FIG. 2.

FIG. 5 shows a plan view of the housing 63, which is of a rectangular cup shape and holds in its interior the rocker arms 25*a* and 25*b* rotatable about their respective support pins 51 and 52, five groups of levers 41, 42 and 43, 44 mounted rotatable about pins 45 and 46 respectively, a pair of levers 41 and 42 pivoted on the pin 46 and three levers 20 mounted rotatable about the pin 55. In this respect, the housing 63 comprises an internal seat 85 of rectangular cross-section arranged to receive the plurality of rocker arms 25*a* and 25*b*. In addition, the rocker arm 25*b*, controlled by the pairs of levers 41*b* and 42*b*, has its slot 55 (not shown) cooperating in a manner not shown with the end pin of a rod 86 in order to impress on this rod a movement of longitudinal translation between a first and a second position, depending upon whether the lever 41*b* or the lever 42*b* is operated, so that the rocker arm 25*b* associated therewith is correspondingly rotated into either a first or a second angular position.

The levers 20 can assume a first or a second angular position relative to the pin 45 as heretofore described with reference to the lever 20 of FIG. 2.

Figure 6:
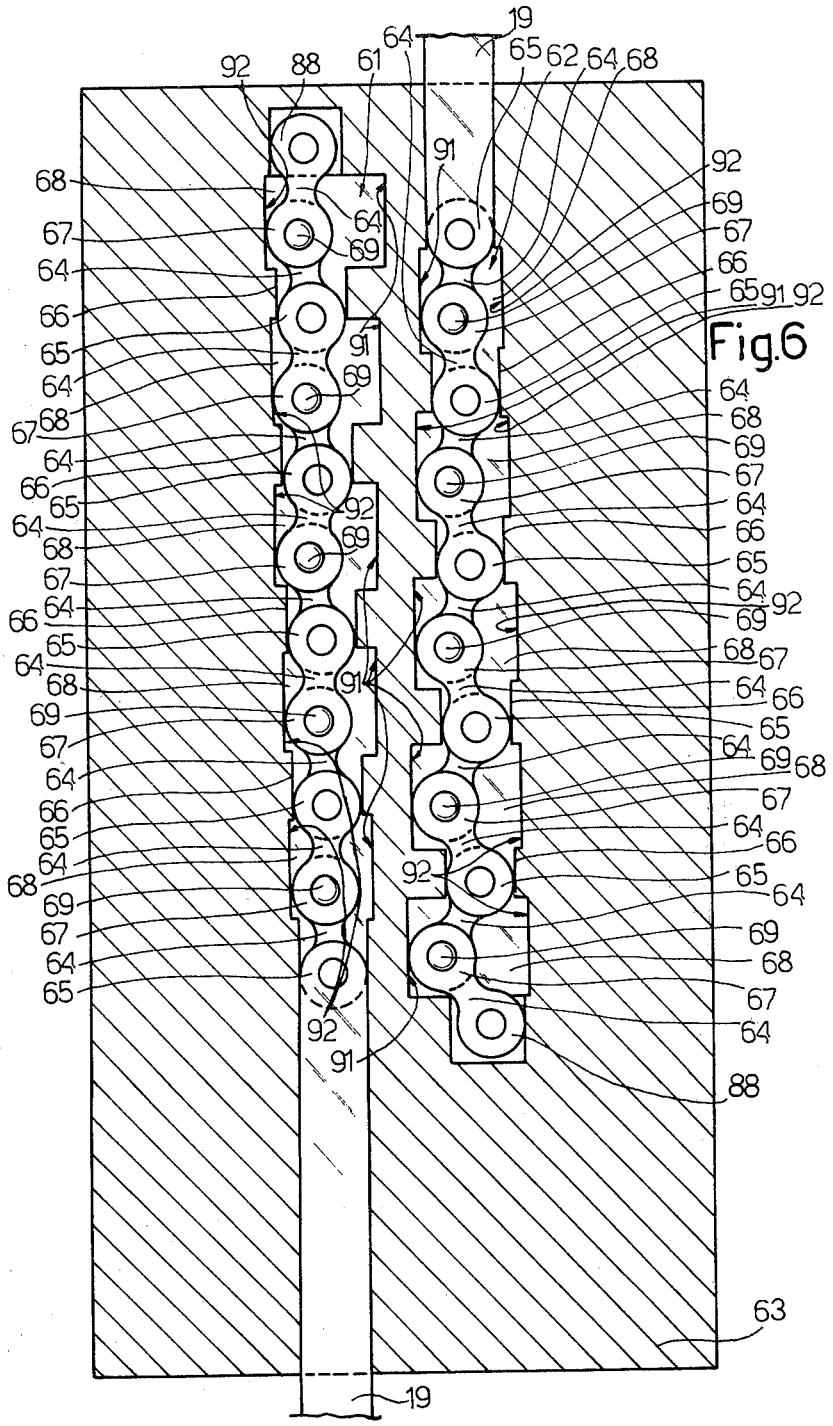
FIG. 6 is a plan view of the second portion of FIG. 5 with certain elements removed for clarity.

FIG. 6 shows a cross-section through the housing 63 which illustrates the whole of the chains 61 and 62, and in particular how these can be disposed inside said chambers 68 and slide along the relative seats 66. In particular, each chain 61, 62 comprises an end ring 88 connected to the housing 63, and at the opposite end is connected to the rod 19 shown in FIG. 1. This latter is subjected to a repective resilient force, in a manner not shown, which acts longitudinally towards the opposite end of each chain 61, 62.

With regard to the structure of each of the chambers 68, five such chambers are shown starting from the ring 64 and progressing towards the ring 65 connected to the rod 19, these chambers having longitudinal facing surfaces, the distance between which progressively decreases in steps. Inside each chamber 68, each ring 67 can assume a first position in which it is in contact with a first lateral surface 91, whose distance from the axis of rotation of each link 64 decreases for each chamber as heretofore specified, or a second position in which it is in contact with a second lateral surface 92 whose distance from the axis of each ring 67 is constant and slightly greater than the radius of said ring. Each ring 67 is arranged to be brought into contact with the surface 91 or 92 by the action exerted on the pin 69 by the rocker arms 25*a* or 25*b* of FIG. 2. In this respect, the distance between the surfaces 92 and 91 is such that a displacement of the link 64 between said two surfaces causes each ring 65 to translate within its slide seat 66 by an amount proportional to 16, 8, 4, 2 or 1 elementary displacement units respectively, depending upon the structure of the chamber 68 and starting from the chamber adjacent to the end ring 88 within which the ring 67 is displaced. As shown in FIG. 6, each ring 67 of the chain 61 rests on the surface 92, whereas each ring 67 of the chain 62 rests on the surface 91. Consequently, the rods 19 operated by the chains 61 and 62 show in FIG. 6 a maximum and minimum longitudinal displacement respectively, relative to the corresponding end ring 88.

Figure 7:
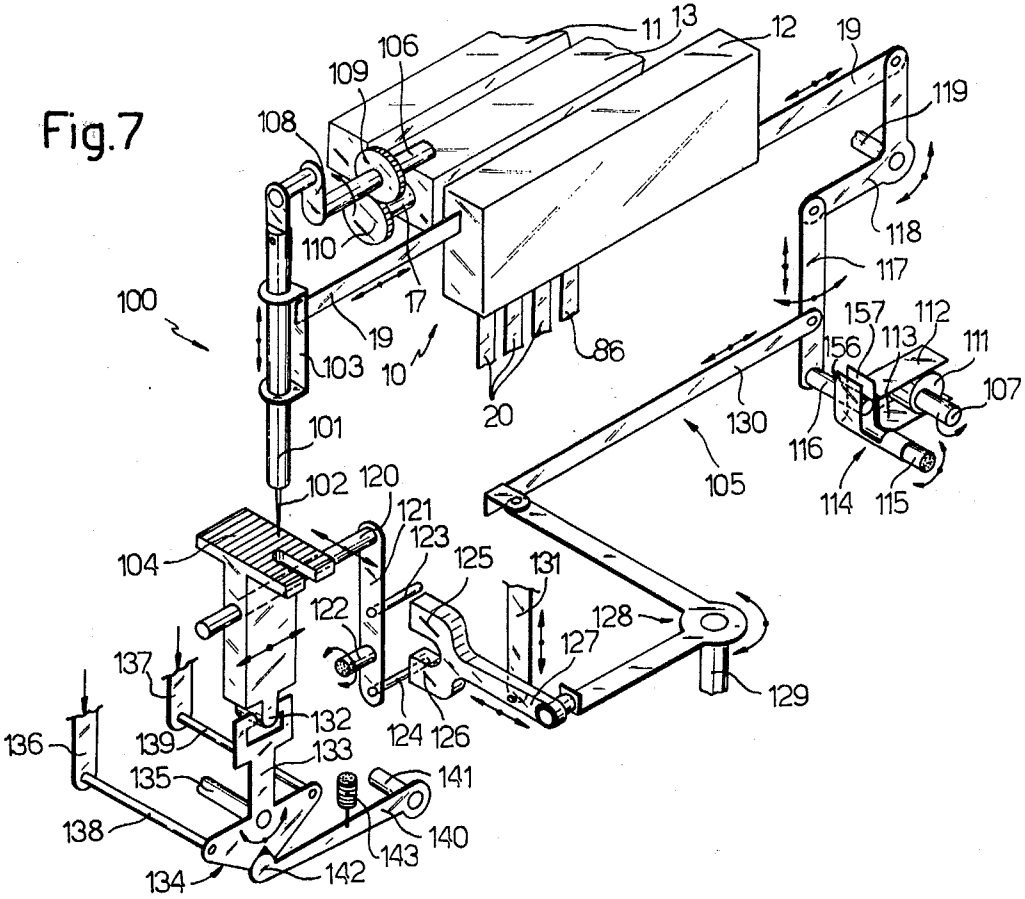
FIG. 7 shows a sewing machine comprising an actuator according to the present invention.

FIG. 7 shows the electromechanical actuator device 10 fitted to a sewing machine indicated overall by 100. In this, the two rods 19 are connected in such a manner that one of them transversely displaces a bar 101 for supporting a needle 102 by way of a relative frame 103, and the other longitudinally displaces a fabric conveying foot 104, by way of a mechanical motion transmission linkage 105. Each lever 20 is used together with the rod 84 to actuate a respective function, as will be described hereinafter.

The sewing machine 100 comprises two drive shafts 106 and 107, which are driven from a single source of motion in a manner not shown. The shaft 106 is coupled by a crank 108 to one end of the needle bar 101, and by means of gear wheels 109 and 110 transmits motion to the shaft 17 which operates said mechanical coupling means 13 for the device 10. The shaft 107 rotatably carries an eccentric cam 111, the outer surface of which cooperates with opposing walls 112 and 113 of a rocker element 114 which rotates about a support pin 115. The element 114 comprises a further pair of parallel walls 156, 157, between which a pin 116 carried at one end of a rod 117 slides in a direction radial to the pin 115. The opposite end of the rod 117 is connected to one end of the rod 19 of the actuator member 12 by means of a right angled lever 118 rotatable about a pin 119.

The conveying foot 104 is mounted on a support shaft 120 which is connected to one arm of a lever 121 rotatable about a pin 122. Two pegs 123, 124 are connected to the lever 121 on the opposite side to the side which holds the pin 120, and cooperate alternately with a first and second end 125 and 126 respectively of the U end portion of a connecting rod 127. This latter is mounted rotatable about one end of an arm of a right angled lever 128 which is rotatable about a support pin 129 and comprises a second arm having its end connected to an intermediate point on the rod 117 by means of a rod 130. The connecting rod 127 is arranged to rotate relative to the end of the right angled lever 128, by the action exerted by a rod 131 which is connected by way of a mechanical motion transmission linkage, not shown, to a first of the levers 20 of the actuator member 12.

The body of the conveying foot 104 slides axially on the shaft 120. In this respect, this body comprises an appendix 132 which cooperates with the forked arm 133 of a rocker arm 134 mounted rotatable about a support pin 135. This rocker arm is provided with arms on opposite sides of the pin 135, which are connected to respective rods 136, 137 by connecting pins 138 and 139. The rods 136 and 137 are connected by a respective mechanical motion transmission linkage, not shown, to a respective second and third rod 20 of the actuator member 12. Finally, the rocker arm 134 is kept in its rest position by a lever 140 rotatable about a support pin 141, this lever comprising an end tooth 142 which is urged resiliently to cooperate with a seat, not shown, in the rocker arm 134 by means of a spring 143.

Finally, a mechanism of known type, not shown, causes the foot 104 to swivel about the shaft 120.

Figure 8:
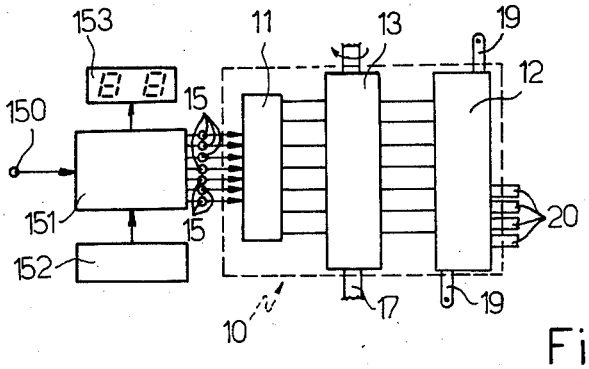
FIG. 8 is an electrical circuit diagram for controlling the electromechanical actuator device according to the invention.

With reference to FIG. 8, a terminal 150 which receives an electrical positioning and synchronism signal emitted by the device 37 of FIG. 2, is connected to the clock input of a processing and control block 151. This latter can comprise for example a microprocessor with its process memory, and be arranged to receive control signals from a keyboard 152 and to display these control signals on display elements 153 of a known type. The processing block 151, which can be made up in any manner, is substantially arranged to feed logic control signals to the feed terminals 15 of the electromechanical actuator device 10 to respective output amplifiers, not shown, contained within the block 151.

The operation of the electromechanical actuator device 10 will firstly be examined, then the behaviour of the sewing machine 100 on which the device is mounted.

In general, and with specific reference to FIG. 1, each of the electromagnets 11 assumes either a rest state or a working state, depending on the value of a respective electrical supply signal which reaches a respective terminal 15. Each of the elements 16 of the coupling means 13 is consequently put into either a respective rest position or working position, depending upon the state of the corresponding electromagnet 11. In this respect, each element 16 takes mechanical power from the shaft 17 to position a corresponding element 18 of the actuator member 12 in either a corresponding rest position or working position. In the actuator member 12, the rods 19 make a displacement of a predetermined extent, and/or the levers 20 move between a first and a second position, depending on the control signal received. In the example illustrated, five electromagnets are disposed for controlling the position of the two rods 19, and two electromagnets 16 are disposed for controlling the two pairs of levers 20.

With reference to FIGS. 2, 3 and 6, the action of one of the electromagnets 11 of the said group of five electromagnets for controlling the displacement of the rod 19 operated by the chain will now be examined.

When the spindle 17 makes a rotation of 360°, a complete cycle is carried out within which each ring 67 of the chain 62 can move from the surface 91 to the surface 92 of the chamber 68. In this respect, the first 180° are used for positioning the cam 35*a*, and the second 180° for carrying out the actual movement. In detail, during a first angular fraction within 90° of the first 180° of the cycle, the armature 21 of the electromagnet 11 is mechanically reset by the projection 30, which cooperates with the facing surface of the tooth 22 of the armature 21 until the armature becomes attracted by the core 71 and is kept in contact therewith by the action of the core. In the meantime, the peg 32 cooperates with the oblique cavity 31 in the semitubular element 29, to axially displace this element from its working position indicated by the dashed line in FIG. 3 to its rest position indicated by the full line in the same Figure.

When a supply pulse is fed to the coil 70 at the end of the said 90°, the magnetic attraction force exerted on the armature 21 by the core 71 is momentarily compensated. Under these conditions, the tooth 22 of the armature 21 moves into the position indicated by the dashed line in FIG. 3, and cooperates frontally with the oblique cavity 33 to displace the element 29 axially into the said working position, which is reached when the shaft 17 (FIG. 2) has made a rotation of 180°. In conclusion, at the end of this first rotational stage of the shaft 17, the cam 35*a* assumes one of the two positions indicated in FIG. 3, depending upon whether the electromagnet 11 has received or has not received the electrical supply pulse for the relative coil 70.

In the next rotational stage of 180°, the cam 35*a* cooperates with the rounded portion 47 of the lever 41 or 42 (FIG. 2). The lever 41 or 42 acts on the tooth 54 or 53 respectively of the rocker arm 25*a* by way of the end appendix 49 of the lever 41 or the tooth 48 (not shown) of the lever 42, in order to cause the rocker arm 25*a* to rotate about the pin 51 in the clockwise or anticlockwise direction respectively (FIG. 2). This rocker arm then causes the ring 67 of the chain 62 to move between the surfaces 91 and 92 of the chamber 68 (FIG. 6), by the transporting action exerted on the pin 69 of the ring 67.

The next ring 65 of the chain 62 is consequently caused to make a longitudinal movement along its slide seat 66 to an extent depending on the structure of said chamber 68, and this movement is transmitted to the remaining part of the chain and thus to the rod 19. As the extent of the longitudinal displacements which can be induced respectively in the five chambers 68 are proportional to 16, 8, 4, 2 and 1 elementary units, displacements of an extent of 0 to 31 elementary units can be induced in the rod 19 by suitable combinations of the signals fed to the electromagnets 11.

The displacements of the rod 19 connected to the end of the chain 61 are induced in a like manner by the same electromagnets 11 as heretofore described with reference to the displacement control signals for the chain 62. These displacements are effected 180° out of phase with the displacements of the chain 62. In this case, a plurality of cams of the same type as the cam 35*b* are used, these cams cooperating by way of the levers 43 or 44 with the teeth 54 or 53 respectively of the rocker arm 25*b*, with this latter acting on the chain 61.

Summarizing, the displacements of the chains 61 and 62 take place with a phase difference of 180° from each other, and these displacements can assume finite values between zero and thirty one elementary units.

With reference to FIG. 5, the rod 86 controlled by the levers 41*b* is arranged to assume a first or a second axial rest position. With regard to each of the three levers 20 illustrated in FIG. 5 and corresponding to the lever 20 of FIG. 2, the action of the relative cam induces in each of them a rotation about the pin 45, but only if the cam is in a position corresponding with their first arm 59.

The operation of the actuator device 10 when fitted to the sewing machine 100 illustrated diagrammatically in FIG. 7 will now be described.

As heretofore stated, the needle bar 101 and conveying foot 104 are driven respectively with axial and longitudinal reciprocating motion by the shafts 106 and 107.

The needle bar 101 is also displaced transversely to an extent depending on the position assumed by the rod 19 of the device 10, which transmits its movement to the support frame 103 of the needle bar.

The other rod 19 of the device 10 governs the longitudinal displacements of the conveying foot 104 by varying the radial distance between the pin 116 and the pin 115. In this respect, when the pin 116 is aligned with the pin 115, the swing movements induced in the rocking arm 114 by the rotation of the shaft 113 are not transformed into longitudinal movement of the rod 130 and therefore produce no longitudinal displacement of the conveying foot 104. This displacement is however a maximum when the distance between the pin 116 and pin 115 is a maximum. In addition, the foot 104 can either be displaced forwards or backwards by controlling the displacement of the connecting rod 127, by one of the levers 20, such that either the end 125 cooperates with the peg 123 or the end 126 cooperates with the peg 124 of the lever 121.

Finally, it is possible to induce a transverse displacement in the conveying foot 104 by using a pair of levers 20 to operate the rods 136 or 137 which, by way of the rocker arm 134, cause the foot 104 to slide transversely relative to the shaft 120 by a fixed amount. Finally, the longitudinal displacements of the rod 86 or of other levers 20 could be used for similar purposes.

With reference to FIG. 8, information concerning the various types of embroidery which can be carried out by the sewing machine 100 can be previously stored in the process memory contained in the processing block 150. The keyboard 152 can be operated to select the type of embroidery to be carried out by the sewing machine, and the processing block 151 feeds successive groups of logic signals to the input terminals 15 of the actuator device 10. By way of the device 10, each group of signals determines the position of the needle bar 101 and conveying foot 104 so that the needle 102 enters at a predetermined point of the material and therefore carries out the required embroidery stitch for stitch.

Examining the characteristics of the present invention, it is apparent that the electromechanical actuator device 10 attains the aforesaid objects.

In this respect, the device is able to provide two different types of service in that by using substantially the same elements, not only are the rods 19 displaced through an amount adjustable over a wide range, but also the levers can be moved between two opposing positions, so that it is possible to operate any element to be moved in a reciprocating manner.

As the device 10 receives its mechanical power from the shaft 17, low power electromagnets can be used, and these besides being of low noise require only a minimum current for their operation. For example, in order to activate the electromagnet 11 of FIG. 4, a current pulse is fed to the coil 70 only for a relatively short period of time, and it is reset to its initial conditions, i.e. the armature 21 is reset, by utilizing the mechanical power provided by the shaft 17. Finally, as the movements of each mechanical part of the device 10 are strictly linked and are coordinated with the control signals fed by the processing block 51 to the input terminals 15 of the device 10, the device 10 can be operated at very high speeds by the device 37 of FIG. 2, as there is perfect synchronization between the mechanical and electronic parts of the device 10.

A further embodiment of an actuator device according to the present invention is shown by way of non-limiting example in FIGS. 9 to 12.

Figure 9:
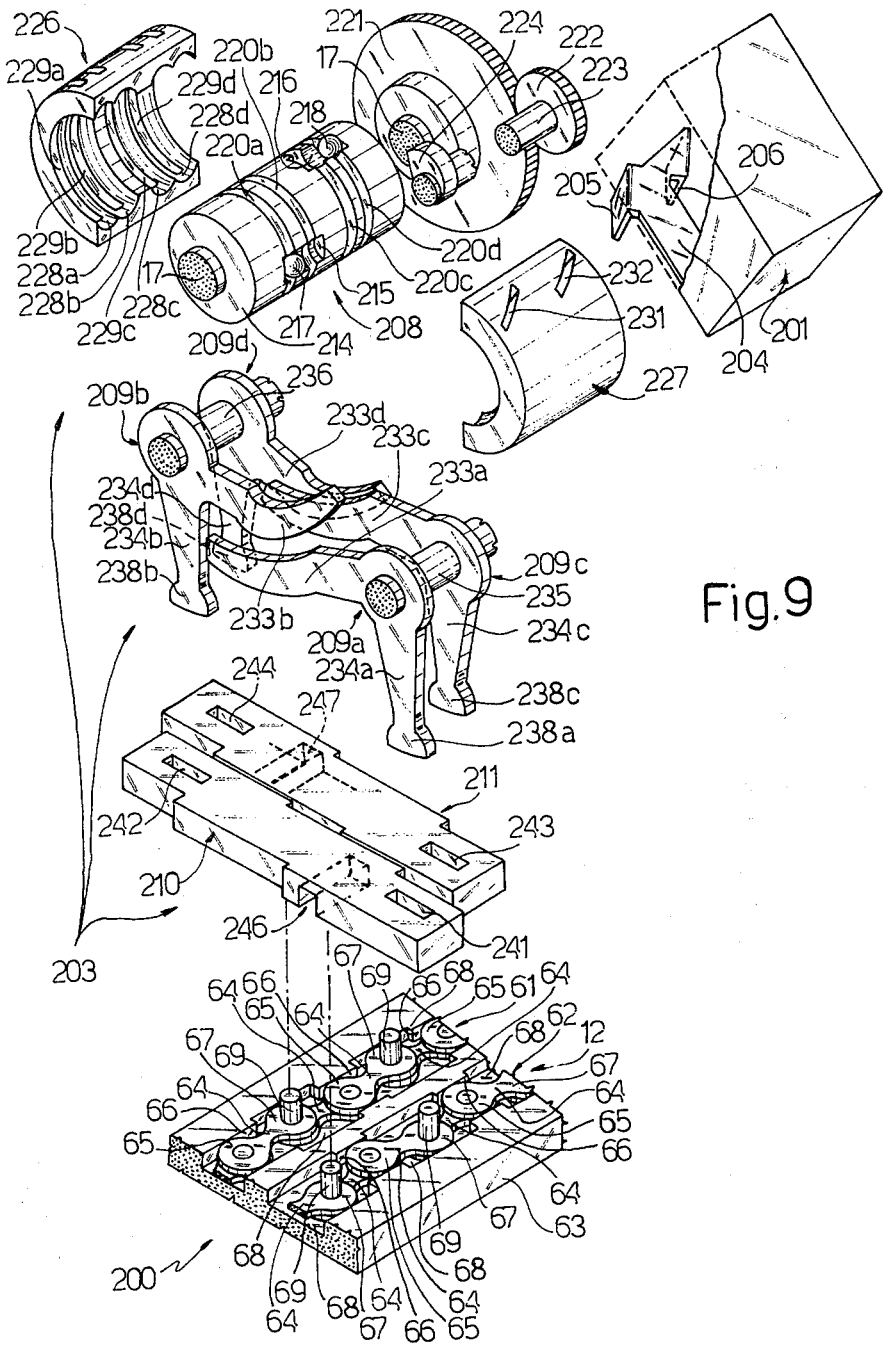
FIG. 9 is a perspective exploded view of said further actuator device constructed in accordance with the teachings of the present invention.

More particularly, with reference to FIG. 9, an actuator device, indicated overall by the reference numeral 200, comprises an electromagnet 201, the actuator member 12 and a portion of mechanical coupling means 23 disposed between the electromagnet 201 and the actuator member 12.

Figure 10:
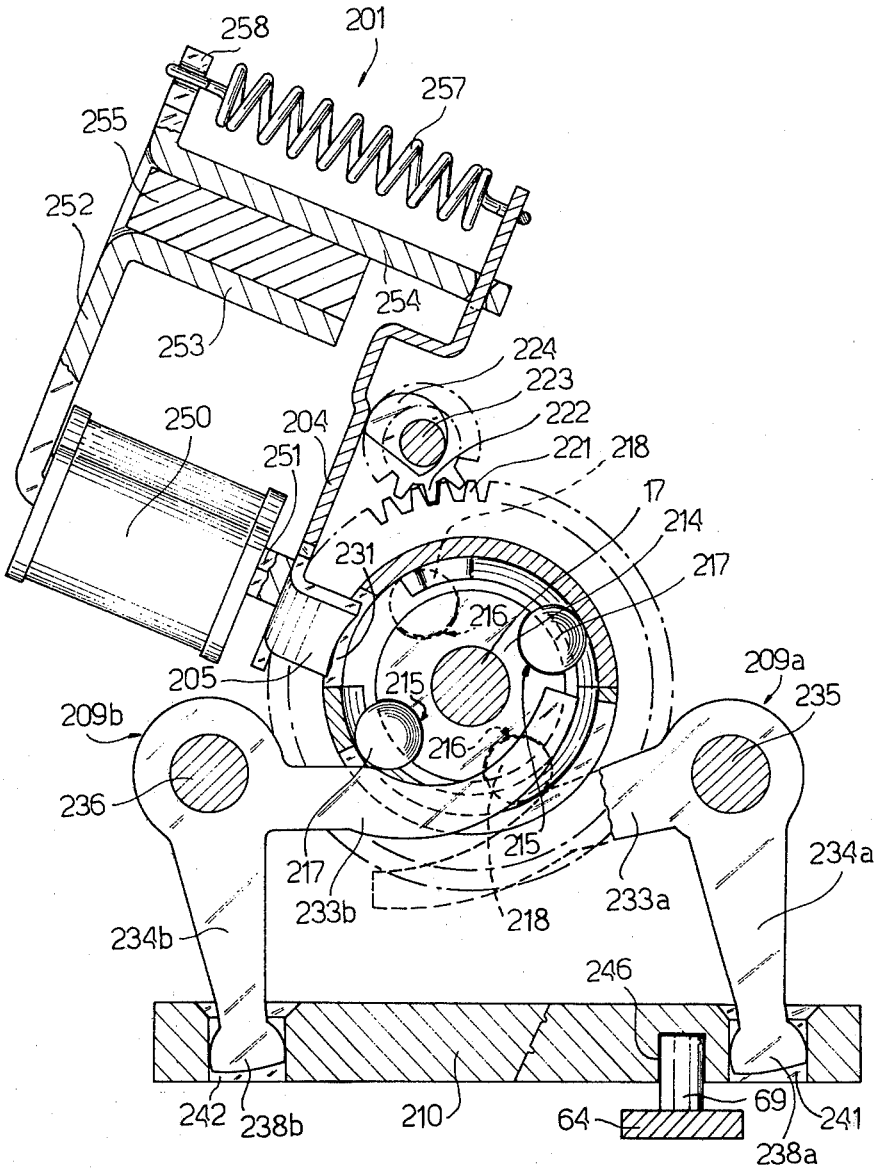
FIG. 10 is an enlarged side view of a first portion of the device of FIG. 9.

More particularly, electromagnet 201 which will be described more in detail with reference to FIG. 10, is of the type which has to be reset mechanically. In particular, the electromagnet comprises a mobile armature 204 formed substantially by a shaped lamina bent at one end so as define two oblique tabs 205 and 206 respectively, bent by 90° relative to the plane defined by the armature 204.

The mechanical coupling means 203 comprise a clutch assembly 208, a plurality of central levers 209*a*, 209*b*, 209*c*, 209*d* and a pair of sliders 210, 211.

The clutch assembly 208 comprises substantially a drum 214 coupled angularly with the drive shaft 17, from which it receives a continuous rotation motion about its own axis. The drum 214 comprises on its side surface a first and second pair of recesses, angularly offset by 90° with respect to one another and axially spaced from one another, indicated by reference numerals 215 and 216 respectively (see also FIG. 10). More particularly, each recess 215, 216 extends axially along the outer surface of the drum 214 and is apt to receive a respective ball 217, 218 apt to slide axially within the respective recess between opposite end portions (see also FIG. 3). Corresponding with the opposite end positions of each recess the drum 214 has a pair of annular notches indicated respectively by reference numeral 220*a*, 220*b* those which pertain to the recess 215, and by reference numerals 220*c*, 220*d* those which pertain to the recess 215 (see also FIG. 11).

Keyed on the shaft 17 is a gear 221 which engages with a gear 222 keyed on a respective shaft 223. The ratio between the teeth of the gear 222 and those of the gear 221 is 1:4; finally, the shaft 223 carries a cam 224 keyed thereon, which acts as a mechanical reset element for the armature 204 of the electromagnet 201 (see also FIG. 10).

The drum 204 is rotatable between two semi-tubular covers indicated by reference numerals 226 and 227 respectively. More particularly, cover 226 has, in correspondence with the annular notches 220*a*, 220*b*, 220*c*, 220*d* of the drum 214, sliding seats of semi-circular cross-section indicated by reference numerals 228*a*, 228*b*, 228*c*, 228*d* respectively, each of which is provided with a respective radial notch 229*a*, 229*b*, 229*c*, 229*d*.

Cover 227 is provided with the radial through slits 231, 232, apt to receive, respectively, the tabs 205, 206 of the movable armature 204 and is also provided with sliding seats, the development of these latter being shown in FIG. 12*c* and will be described later with reference to this FIG. 12*c*.

Each of the levers 209*a*, 209*b*, 209*c*, 209*d* has two respective arms 233*a*, 233*b*, 233*c*, 233*d* and 234*a*, 234*b*, 234*c*, 234*d*, disposed at substantially 90° from each other. More particularly, the levers 209*a* and 209*c* are mounted rotatable about a support pin 235; analogously, the levers 209*b* and 209*d* are mounted rotatable about a respective support pin 236. Furthermore, the free end of each arm 233*a*, 233*b*, 233*c*, 233*d* is shaped in the form of an arc of circumference and is apt to engage the respective notch 220*a*, 220*b*, 220*c*, 220*d* of the drum 214 by passing through the radial notch 229*a*, 229*b*, 229*c*, 229*d* of the semi-circular cover 226. Each arm 234*a*, 234*b*, 234*c*, 234*d* of the said levers has a free end 238*a*, 238*b*, 238*c*, 238*d* of enlarged section and defined laterally by two opposite curved surfaces having as profile two sections of the same circumference.

Finally, each slider 210, 211 is substantially board-shaped and has two pairs of through holes indicated by reference numerals 241, 242 and 243, 244 respectively, which receive, respectively, the ends 238*a*, 238*b*, 238*c*, 238*d* of said levers (see FIG. 10). On the side turned towards the actuator member 12, each slider 210, 211 has a transversal groove 246, 247, each of which engages the pin 69 extending from the corresponding ring of the link 64 of the actuator member 12.

FIG. 10 is a sectional view showing the various elements forming the FIG. 9, in the way they are actually mounted. In this FIG. 10 the structure of the electromagnet 201 is particularly visible, comprising a coil 250 wound about a magnetic core 251 forming an arm of a U-shaped support element 252. A second arm 254 of the element 252 is connected to a support bracket 254 of ferromagnetic material, by means of an interposed permanent magnet 255, for example a magnetic rubber. The bracket 254 extends beyond the magnet 255 and supports pivotally the end of the armature 204 which is opposite to the end carrying the tabs 205 and 206. This end is connected, by means of a cylindrical spring 257, to a 90° bent projection 258 of the said bracket 254.

FIG. 12*a* shows the behavior of the movement of the armature 204 during one turn of the shaft 17, presuming, in particular, that the electromagnet 201 is energized only once during the 360° and by means of a pulse indicated by reference numeral 260.

FIG. 12*b* shows the behavior of the mechanical actuatin signal transmitted by the cam 224 to the armature 204 and which produces every 90° the reset of the said armature 204.

FIG. 12*c* shows the development in a plane of the grooves with which the semi-tubular covers 226 and 227 are provided internally. In particular, it can be seen that the cover 227 has an inclined wall 261 which conveys the balls to the unique axial position corresponding to the position shown in FIG. 9, i.e. along the direction defined by the notch 220*a*. The zone comprised between 90° and 180° of the grooves of the cover 227 corresponds in FIG. 9 to that in which the slit 231 is formed which allows the passage of the tab 205 of the armature 204. In said zone, the amplitude of the groove of the cover 227 expands in order to allow ball 217 to enter the seat 228*a* or 228*b*, depending on the presence or absence of the tab 205.

Finally, FIG. 12*b* shows the behavior of the displacement of the slider 210 in consequence of the actuation command received by the lever 209*b* controlled by the ball 217 (see FIGS. 9 and 10).

The operation of the electromagnetic actuator device 200 is as follows.

Figure 12:
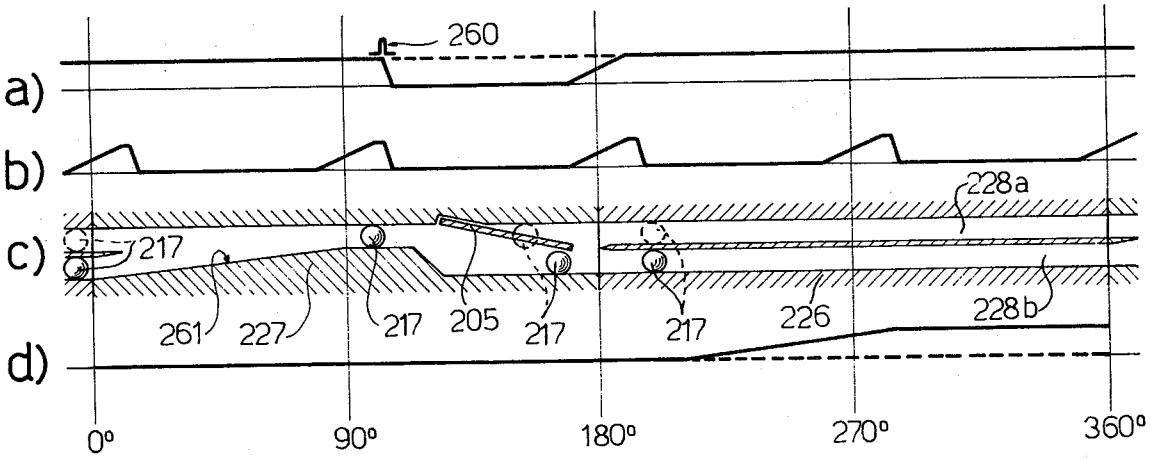
FIGS. 12*a*, 12*b*, 12*c*, and 12*d* show the behavior of some magnitudes of the device constructed in accordance with the present invention, during a 360° rotation of a drive shaft of the said device.
Figure 11:
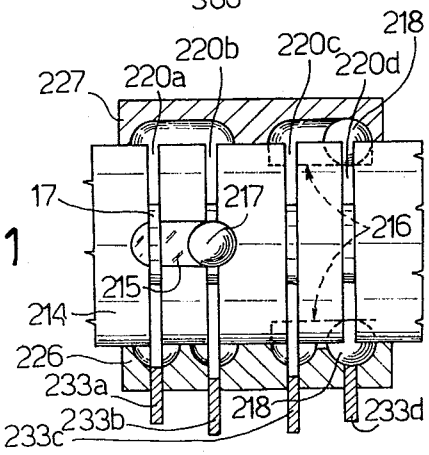
FIG. 11 is an enlarged front view of a portion of the device of FIG. 9.

During a rotation of 360° of the drive shaft 17 (see FIG. 12), a complete preparation and actuation cycle for each ball 217 or 218 is carried out. In FIG. 12*c*, the first 180° of rotation of the shaft 17 serve to prepare the position assumed by the ball 217 and the second 180° constitute substantially the actuation stage of the ball 217. Since the balls 217 made to rotate by the shaft 17 by means of the drum 214 are in number of two and diametrically opposite to one another, the stage of preparation of a ball coincides with the stage of actuation of the opposite ball. Therefore, there is always a ball in the stage of preparation and a ball in stage of actuation. An analogous consideration is to be made also for the pair of balls 218, with the only difference that these balls are offset by 90° relative to the balls 217.

More particularly, and with reference to FIGS. 9, 10 and 12*b*, the drive shaft 17, by means of the gears 221 and 222, transmits to the shaft 232 a rotational motion at angular speed which is four times higher than its own rotational speed, so that the cam 224 resets the armature 204 of the electromagnet 201 every 90°. With particular reference to FIG. 12*c*, whichever position the ball 217 may assume as it leaves the semicircular seat 228*a* or 228*b* of the cover 226 to enter and slide inside the cover 227, the ball 217, after 90° rotation of the shaft 17, is conveyed to the position in face of the seat 228*a* of the cover 226. The displacement of the trajectory takes place in particular when the ball 217 assumes the position shown in full lines at the angle of 0°, in which case it follows the behaviour of the inclined plane 261 assumed by the cover 227. In the successive 90° rotation (between 90° and 180°) of the shaft 17, the ball 217 (see FIG. 4*c*) may be conveyed towards two distinct longitudinal positions within the recess 215 (FIG. 11) in the position assumed by the tab 205 of the movable armature 204. In the case in which the coil 250 of the electromagnet 201 receives the pulse 260 (FIG. 12) the armature 204 of this electromagnet, since it is no more attracted by the core 251, follows the behaviour of the full line of FIG. 12*a*, inasmuch as it is attracted by the return spring 257 (FIG. 10). The armature 204 is then reset again by the cam 224 near the 180° rotation angle. If the electromagnet 201 has been energized, in the interval between 90° and 180° the tab 205 conveys the ball 217 towards the portion cover 227 facing the seat 228*b* of the cover 226. In the contrary case (see the dashed portion of FIG. 12*a* and the dashed ball 217), the armature 204 results in being attracted by the core 251 and therefore the ball 217 (dashed) continues moving and enters the semicircular seat 228*a* of the cover 226.

At this point there is initiated the actuation stage controlled by the ball 217. In particular, this ball, depending on whether it slides within the seat 228*a* or within the seat 228*b*, cooperates respectively and progressively with the arm 233*a* or with the arm 233*b*, respectively, of the levers 209*a* or 209*b* (see in particular FIG. 10). In case the ball acts on the arm 233*a* (FIG. 10), it gives rise to a rotation of the lever 209*a* anticlockwise about the pin 235, with the consequent displacement from the left to the right of the slider 210. Accordingly, this latter will transmit the said displacement to the link 64 by acting on the pin 69 connected to this link. In the contrary case, the ball 217 acts on the arm 233*b* of the lever 209*b*, thereby inducing in this latter a clockwise rotation about the pin 236 and therefore, finally, a displacement from the right to the left of the slider 210 and the pin 69 of the link 64.

As can be seen from FIG. 1, the sliders 210 and 211 act in the pins 69 of the chains 62 and 61, respectively; since they are substantially controlled by the balls 217 and 218 respectively by means of the levers 209*a*, 209*b* and 209*c*, 209*d*, each of them accomplishes a complete cycle of preparation and actuation in 180°, of which substantially 90° are of preparation and the remaining 90° are of actuation. Such complete cycles are offset by 90° with respect to one another, and this is necessary for the operation of the sewing machine mentioned hereinabove, inasmuch as the ends not shown of the chains 61 and 63 control alternately and respectively the displacements of the needle bar and the fabric conveying foot.

Finally, it is apparent that modifications can be made to the actuator device according to the present invention, without leaving the scope of the inventive idea.

What we claim is

1. An electromechanical actuator device for a sewing machine, characterized by comprising a plurality of electromagnets (11, 201), each of which is arranged to be put into either a rest state or a working state, depending upon a respective electrical feed signal; at least one actuator member (12) connectable to a fabric conveying foot in the said sewing machine and arranged to assume either a rest position or a working position corresponding respectively to said rest state or working state of each of said electromagnets; a plurality of mechanical coupling means (13, 203) disposed between said plurality of electromagnets (11, 201) and said actuator member (12), and a drive shaft (17) which is actuated by means of a power take-off and actuates the said mechanical coupling means (13, 203); each of said mechanical coupling means (13, 203) being arranged to be put either into a respective rest position or working position, depending on the state of a corresponding electromagnet (11, 201), and to mechanically set said actuator (12) into either said rest position or working position; said actuator member (12) including a plurality of displacement actuating units (18) associated with corresponding electromagnets (11, 201); said actuating units (18) being connected to one another in such a manner as to give rise to a resultant displacement depending on the overall pattern of said rest and working states assumed by said electromagnets (11, 201); each actuating unit (18) including a pair of links (64) of a chain (61, 62), a junction ring (67) between said links (64) being arranged to be displaced between a rest position in which it is located at a first radial distance from a reference axis passing through the center of end rings (65, 88) of said links (64), and a working position in which it is located at a second radial distance from said reference axis, and correspondingly an end ring (65) of a first link of said pair of links assumes a first or second position along said reference axis relative to an opposite end ring (88) of the second link of said pair of links.

2. A device as claimed in claim 1, characterized in that said first radial distance assumable by each of said junction rings (67) of each of said pair of links of an actuating unit (18) is different from that assumable by a respective junction ring (67) of pairs of links of other actuating units (18).

3. A device as claimed in claim 2, characterized in that said first radial distance in each pair of links (64) is such as to determine a displacement of said end ring (65) by a number of elementary units proportional to a power of the number two.

4. A device as claimed in claim 3, characterized in that each pair of links is housed in a respective chamber (68) provided with lateral walls which act as a stop for the displacements of said junction ring (67), and communicating with an adjacent chamber (68) by way of a duct (66) which acts as a slide seat for said end rings.

5. A device as claimed in claim 1, characterized in that said junction ring (67) comprises a pin (69) arranged to cooperate with an element (25*a*, 25*b*; 210, 211) of said mechanical coupling means (13, 203), so as to be displaced into said rest or working position.

6. An electromechanical actuator device for a sewing machine, characterized by comprising a plurality of electromagnets (11), each of which is arranged to be put into either a rest state or a working state, depending upon a respective electrical feed signal; at least one actuator member (12) connectable to a fabric conveying foot in the said sewing machine and arranged to assume either a rest position or a working position corresponding respectively to said rest state or working state of each of said electromagnets; a plurality of mechanical coupling means (13), disposed between said plurality of electromagnets (11) and said actuator member (12), and a drive shaft (17) which is actuated by means of a power take-off and actuates the said mechanical coupling means (13); each of said mechanical coupling means (13) being arranged to be put either into a respective rest position or working position, depending on the state of a corresponding electromagnet (11), and to mechanically set said actuator (12) into either said rest position or working position; each of said mechanical coupling means including at least one element (29) axially slidable relative to the said drive shaft (17); the said slidable element (29) being arranged to be set into a rest position or working position following the receipt of a mechanical control signal produced by a corresponding electromagnet (11); said slidable element (29) comprises a zeroing recess (31) and a positioning recess (33) which are angularly displaced from each other and are arranged to cooperate with a peg (32) and with an armature (21) of said electromagnet (11) respectively, in order to set said element into said rest position or working position.

7. A device as claimed in claim 6, characterized in that said slidable element (29) comprises at least one cam (35*a*, 35*b*) arranged to act indirectly on said actuator member (12) to set said actuator member (12) into said rest or working position.

8. A device as claimed in claim 6 characterized by comprising a pair of said slidable elements (29), each of which is of semi-tubular structure and is arranged to be set into said rest position or working position following the receipt of said mechanical control signal produced by a single electromagnet (11).

9. A device as claimed in claim 8 characterized in that said cam (35*a*) carried by a first element of said pair of slidable elements (29) is axially offset from said cam (35*b*) carried by a second element of said pair of slidable elements (29).

10. A device as claimed in claim 9 characterized in that said element (25*a*, 25*b*) of said mechanical coupling means (13) is of rocker arm configuration and comprises a first and second tooth (53, 54) which are axially offset from each other and are arranged to cooperate with said cam (35*a*, 35*b*) when said cam assumes said rest or working position.

11. A device as claimed in claim 10, characterized by comprising a pair of said plurality of actuating units (18); each electromagnet (11) being arranged to position said pair of slidable elements (29) at successive times, and each of said slidable elements (29) being arranged to act on a respective unit of said pair of actuating units (18).

12. An electromechanical actuator device for a sewing machine, characterized by comprising a plurality of electromagnets (201), each of which is arranged to be put into either a rest state or a working state, depending upon a respective electrical feed signal; at least one actuator member (12) connectable to a fabric conveying foot in the said sewing machine and arranged to assume either a rest position or a working position corresponding respectively to said rest state or working state of each of said electromagnets; a plurality of mechanical coupling means (203) disposed between said plurality of electromagnets (201) and said actuator member (12), and a drive shaft (17) which is actuated by means of a power take-off and actuates the said mechanical coupling means (203); each of said mechanical coupling means (203) being arranged to be put either into a respective rest position or working position, depending on the state of a corresponding electromagnet (201), and to mechanically set said actuator (12) into either said rest position or working position;

each of said mechanical coupling means including at least one element (217, 218) axially slidable relative to the said drive shaft (17); the said slidable element (217, 218) being arranged to be set into a rest position or working position following the receipt of a mechanical control signal produced by a corresponding electromagnet (201); wherein said slidable element (217, 218) is a ball and said drive shaft (17) is angularly coupled to a drum (214), on the outer surface of which there are formed recesses (215, 216), each of which receives a respective ball 217, 218.

13. A device as claimed in claim 12, characterized by comprising a pair of semi-tubular covers (226, 227) mounted around the said drum (214), and in that a first cover (226) has grooves (228*a*, 228*b*, 228*d*) formed therein to correspond with the said recesses (215, 216) and which cooperate with the said recesses (215, 216) to define a lodging seat for the said balls (217, 218).

14. A device as claimed in claim 13, characterized in that a second cover (227) of the said pair of covers (226, 227) has at least one oblique notch (261) apt to cooperate with the said balls (217, 218), so as to convey each ball to a pre-established axial position around the respective recess (215, 216).

15. A device as claimed in claim 14, characterized in that said cover has a pair of slits (231, 232) apt to be engaged by corresponding tabs (205, 206) of an armature (204) of said electromagnet (201); each said tab (205, 206) being arranged to cooperate with said ball (217, 218) in order to convey this latter into a first group of said grooves (228*a*, 228*c*) or into a second group of said grooves (228*b*, 228*d*).

16. A device as claimed in claim 13, characterized in that each said groove (228*a*, 228*b*, 228*c*, 228*d*) of said first cover (226) is provided with a respective slit (229*a*, 229*b*, 229*c*, 229*d*) arranged to be engaged by a first arm (233*a*, 233*b*, 233*c*, 233*d*) of a respective bell crank lever (209*a*, 209*b*, 209*c*, 209*d*).

17. A device as claimed in claim 16 characterized in that a second arm (234*a*, 234*b*, 234*c*, 234*d*) of the said bell crank lever (209*a*, 209*b*, 209*c*, 209*d*) engages a corresponding through hole (241, 242, 243, 244) provided on the said element (210, 211) of the said mechanical means.

18. A device as claimed in claim 12 characterized by comprising two axially offset pairs of said balls (217, 218); the said balls (217, 218) of each pair being accomodated in diametrically opposite recesses (215, 216).

19. An electromechanical actuator device for a sewing machine, characterized by comprising a plurality of electromagnets (11, 201), each of which is arranged to be put into either a rest state or a working state, depending uon a respective electrical feed signal; at least one actuator member (12) connectable to a fabric conveying foot in the said sewing machine and arranged to assume either a rest position or a working position corresponding respectively to said rest state or working state of each of said electromagnets; a plurality of mechanical coupling means (13, 203) disposed between said plurality of electromagnets (11, 201) and said actuator member (12), and a drive shaft (17) which is actuated by means of a power take-off and actuates the said mechanical coupling means (13, 203); each of said mechanical coupling means (13, 203) being arranged to be put either into a respective rest position or working position, depending on the state of a corresponding electromagnet (11, 201), and to mechanically set said actuator (12) into either said rest position or working position; each of said electromagnets (11, 201) is of the normally energized and mechanically reset type; and cam means (30, 224) operated by means of a drive shaft (17) and arranged to cooperate cyclically with the armature (21, 204) of said electromagnet (11, 201) to mechanically reset said armature (21, 204).

20. An electromechanical actuator device for a sewing machine, characterized by comprising a plurality of electromagnets (11, 201), each of which is arranged to be put into either a rest state or a working state, depending upon a respective electrical feed signal; at least one actuator member (12) connectable to a fabric conveying foot in the said sewing machine and arranged to assume either a rest position or a working position corresponding respectively to said rest state or working state of each of said electromagnets; a plurality of mechanical coupling means (13, 203) disposed between said plurality of electromagnets (11, 201) and said actuator member (12), and a drive shaft (17) which is actuated by means of a power take-off and actuates the said mechanical coupling means (13, 203); each of said mechanical coupling means (13, 203) being arranged to be put either into a respective rest position or working position, depending on the state of a corresponding electromagnet (11, 201), and to mechanically set said actuator (12) into either said rest position or working position; a plurality of displacement actuating units (18) associated with corresponding electromagnets (11, 201); said actuating units (18) being connected to one another in such a manner as to give rise to a resultant displacement depending on the overall pattern of said rest and working states assumed by said electromagnets (11, 201); each output of said pair of pluralities of actuating units (18) is mechanically connected to a needle bar (101) and a fabric conveying foot (104) in said sewing machine in such a manner as to cause a needle carried by said needle bar (101) to move transversely relative to the fabric feed direction in said machine, and to cause said conveying foot (104) to move cyclically in a longitudinal direction; said actuator member (12) comprises at least one rod (19, 86) and/or lever (20) which are arranged respectively to assume an axial or angular rest or working position, to correspond with a rest or working state of a corresponding electromagnet (11, 201); one of said rods or levers (20) cooperates with an element (131) of a mechanical motion transmission chain disposed between said output of said plurality of actuating units and said conveying foot (104), in order to determine a reversal of the direction of the longitudinal displacement transmitted to said conveying foot (104); and wherein a pair of said rods or levers (20) cooperates with a rocker element (134) to determine a transverse displacement of said conveying foot (104) in opposite directions.

* * * * *